US006937740B2

(12) United States Patent
Dage

(10) Patent No.: US 6,937,740 B2
(45) Date of Patent: Aug. 30, 2005

(54) MONOPOLE LOW FREQUENCY TEST WOOFER

(75) Inventor: David Alan Dage, Southfield, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 304 days.

(21) Appl. No.: 09/832,574

(22) Filed: Apr. 11, 2001

(65) Prior Publication Data

US 2001/0040970 A1 Nov. 15, 2001

Related U.S. Application Data

(63) Continuation of application No. 09/123,400, filed on Aug. 3, 1998, now abandoned.

(51) Int. Cl.[7] ..... H04R 1/02
(52) U.S. Cl. ..... 381/389; 381/87; 381/58
(58) Field of Search ..... 381/386, 389, 381/370, 371, 374, 384, 87, 58; 181/141, 160

(56) References Cited

U.S. PATENT DOCUMENTS 4,065,645 A * 12/1977 Warner et al. ..... 381/379
4,302,635 A * 11/1981 Jacobsen et al. ..... 381/371
4,853,966 A * 8/1989 Skrzycki ..... 381/395
4,961,227 A * 10/1990 Le Donne ..... 381/336
5,153,915 A * 10/1992 Farella ..... 381/99
5,532,437 A * 7/1996 Simplicean et al. ..... 181/150
5,867,582 A * 2/1999 Nagayoshi ..... 381/370
5,996,727 A * 12/1999 Blind et al. ..... 181/141

* cited by examiner

*Primary Examiner*—Brian T. Pendleton
(74) *Attorney, Agent, or Firm*—John Kajander

(57) ABSTRACT

A monopole low frequency test woofer (10) has a rigid mounting plate (12) with an acoustical opening (14), a monopole driver (16) with a high mass cone and low resonance mounted on the mounting plate with the basket (13) of the driver fitting about the opening, and a rear tub (20) attached to the mounting plate forming a sealed enclosure about the driver. An inductor (18) is also in connected in series with the monopole driver inside the enclosure. The sealed enclosure has an electrical connector (26) for making connection to an external circuit. The difference in outputs between the test woofer and standard optimized speaker represents the loss in baffling due to the vehicle environment being less than ideal.

3 Claims, 1 Drawing Sheet

MONOPOLE LOW FREQUENCY TEST WOOFER

CROSS-REFERENCE TO RELATED APPLICATIONS

This application is a continuation of application Ser. No. 09/123,400 filed Aug. 3, 1998, now abandoned.

FIELD OF THE INVENTION

The invention relates generally to an audio system for use in a vehicle, and, more particularly, to an apparatus and method for determining loss in baffling due to the speaker environment in the vehicle being less than ideal.

BACKGROUND OF THE INVENTION

In typical home audio systems, the loudspeaker drivers are mounted in wooden or plastic boxes that provide acoustical isolation between the front and rear output of the driver and reinforce the speaker driver's low frequency output. In contrast, automotive sound systems typically employ a dipole speaker mounted in an infinite baffle configuration using the inside of the doors or trunk as the enclosure and rely on the vehicle sheet metal and interior trim as a baffle. A baffle isolates the sound pressure emanating from the front and rear of the speaker cone. Proper baffling is important because the sound from the front and rear of the speaker are 180 degrees out of phase and will cancel each other at lower frequencies.

Overall speaker low frequency performance in a vehicle is affected by door inner access holes, water sealing, door trim stiffness, and door trim fastener locations. It is important to know how speaker package designs compare with an ideal environment (perfect baffle). The difference in performance between an ideal environment and a vehicle environment represents the loss in baffling. The frequency range of interest is from about 40 Hz to about 200 Hz. Accordingly, it will be appreciated that it would be highly desirable to have an apparatus and method for determining loss in baffling due to the speaker environment in a vehicle being non-ideal.

SUMMARY OF THE INVENTION

The present invention is directed to overcoming one or more of the problems set forth above. Briefly summarized, according to one aspect of the present invention, a monopole low frequency test woofer has a rigid mounting plate with an acoustical opening. A low resonance loudspeaker driver with a high mass cone is fixed to the mounting plate with the basket of the driver fitting about the acoustical opening, and a tub is attached to the mounting plate forming a sealed enclosure about the driver and cone. An integral electrical connector on the housing provides connection to a speaker circuit. The sealed test woofer is designed to match the physical dimensions and mounting hole pattern of the automotive dipole speaker to which it is being compared. The test driver will fit directly in the vehicle door under test allowing direct acoustical comparisons.

According to another aspect of the invention, a method for characterizing baffling and the non-ideal effects of the speaker environment includes producing a monopole low frequency test woofer with selected acoustical parameters that match the vehicle dipole speaker, measuring acoustical output (frequency response) of the vehicle dipole speaker in its environment, measuring frequency response of the test woofer in same environment, and comparing the frequency responses to determine the difference.

When spectrally matched, the difference in frequency response represents ultimately the loss in baffling due to the speaker environment in a vehicle being less than ideal. When the loss in baffling is determined, items of the vehicle door, such as molding, stiffeners, openings and the like, can be redesigned to lessen the baffling loss and increase low frequency efficiency of the vehicle dipole speaker.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
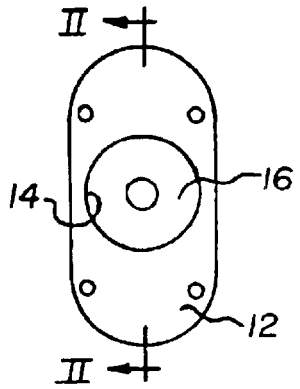
FIG. 1 is a front view of the test woofer of a monopole test woofer constructed according to the present invention.
Figure 2:
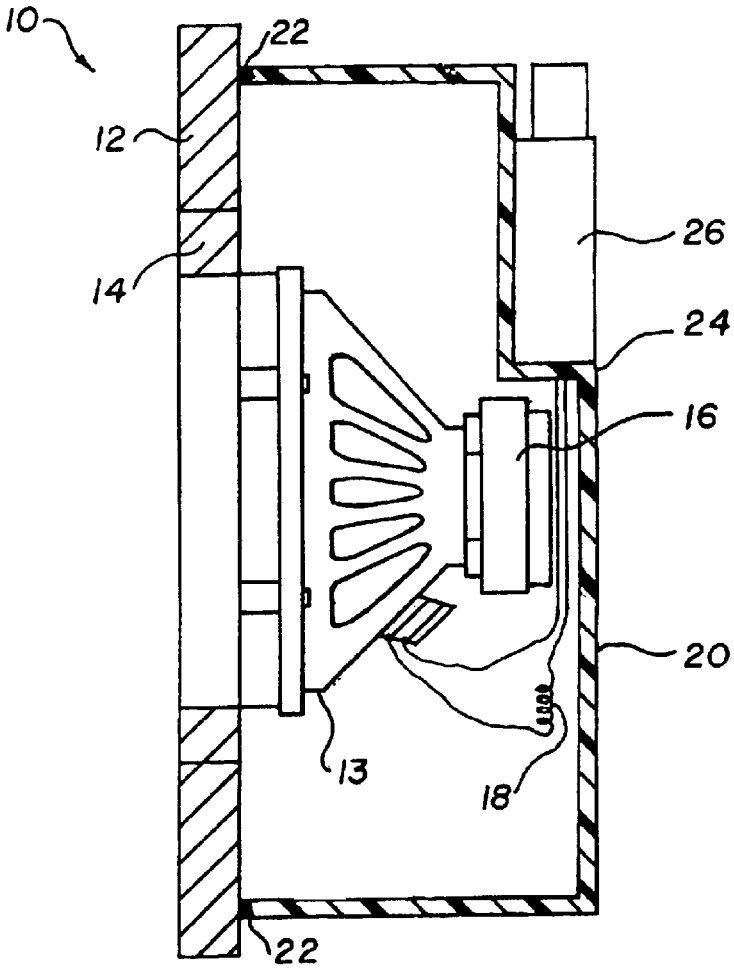
FIG. 2 is a somewhat enlarged sectional view of the test woofer of FIG. 1 taken along line II—II of FIG. 1.

Referring to FIGS. 1 and 2, a monopole low frequency test woofer 10 has a rigid mounting plate 12 with an acoustical opening 14. Mounting plate 12 is matched dimensionally to be comparable to the dipole under test and preferably constructed of one quarter inch thick aluminum with the acoustical opening 14 centered vertically and horizontally. Mounting plate 12 must be rigid and not resonate when monopole low frequency test woofer 10 is excited electrically. Mounting plate 12 has holes that match the hole pattern in the basket 13 of the dipole under test. The mounting plate may also have additional holes for mounting to a test fixture.

A monopole driver 16 is a loudspeaker consisting of a high moving mass and high efficiency magnet that exhibits a free air resonance below 35 Hz. Monopole driver 16 is fastened to mounting plate 12 by screws or the like over the acoustical opening 14. Monopole driver 16 is fed with a series inductor 18 that is used to contour the frequency response of monopole driver 16 to match the typical vehicle dipole speaker.

A rear tub 20 is attached to mounting plate 12 forming an enclosure having an internal volume in the range of one to two liters, depending on package conditions and resonance requirements. The driver 16 and inductor 18 are housed in the enclosure. The rear tub 20 seals to the mounting plate 12 with a sealing gasket 22. This seal prevents any sound from leaving the inside of the rear tub 20 and allows sound to radiate only from the front through the acoustical opening 14. Rear tub 22 may be oval or round or other configuration depending on the geometry of the vehicle dipole speaker to which it is being compared. The rear tub 22 is rigid and does not have any resonances that affect the frequency range of testing. It is preferably constructed of molded plastic.

A slot 24 formed in a rear panel or other location on the rear tub 22 allows clearance for an integral connector 26 which may be molded into the rear tub 22 if made out of plastic material. The slot 24 also allows the integral connector 26 to be flush with the lower, greater depth, portion of the rear or other panel of the tub 22. As illustrated, in the area of the slot 24, a top portion of the rear panel of the tub has less depth than the bottom portion. With the top portion set inward a bit, the slot provides space to receive the integral connector 26 so that integral connector 26 is flush with the lower portion of the back panel of the tub.

The electrical connector 26 is positioned in the slot 24 to connect the monopole driver to an external circuit to drive the speaker. Connector 26 is preferably molded in the tub to maintain the integrity of the air seal so that sound radiates only from the front through the acoustical opening and does not leak out through an opening for electrical connections.

A method for measuring the acoustical loss in a vehicle due to poor baffling includes producing a monopole low frequency test woofer having a frequency response and resonance output matching an optimized vehicle dipole speaker used in the particular vehicle tested. The test woofer is produced by fabricating a rigid mounting plate that has an acoustical opening, mounting a low resonance monopole driver on the mounting plate with the basket of the driver mounted in the acoustical opening, attaching a rear tub that has an integral connector to the mounting plate forming a housing for the driver, attaching an inductor in series with the driver, and connecting the monopole driver to a speaker circuit through the integral connector.

After fabricating the test woofer and ensuring the resonance and frequency response from 40 Hz to 200 Hz are the same, the next step is determining the output of the vehicle dipole speaker in terms of frequency response and resonance. These parameters are measured in the same way. When the frequency response measurements of the dipole and monopole speakers are compared, the sensitivity offset or correction has to be determined. Although the dipole and monopole will have the same resonance and frequency response, the sensitivity will vary between them depending mainly on how large the cone size of the dipole is. With the sensitivity difference known, The dipole frequency response is measured in the vehicle package (door or package tray). The frequency response of the monopole is measured in the same package location with the same input. Knowing the sensitivity difference between the dipole and monopole, the frequency response can be adjusted accordingly for a spectral overlay and the true spectral differences may be compared. The difference between these responses is the loss in baffling due to the speaker environment in the vehicle.

It will be now appreciated that there has been presented an apparatus and method for determining the loss in baffling due to the speaker environment in a vehicle being less than ideal. The present invention uses a test woofer designed as a drop in test module for the existing infinite baffle (dipole) speaker. The rear of the module is fully sealed so that it only radiates sound from the front side of the cone; hence, it is a monopole. The frequency response and resonance of the monopole would match the characteristics of the dipole speaker. When the outputs of the two are measured and compared in the vehicle environment with appropriate level correction, the difference is the loss in baffling due to the speaker environment being non-ideal, that is, leaky or resonant. This provides a reference of how well a particular speaker will play in that location. The invention may also be used for noise and vibration harshness (NVH) sound package development since it can function as a noise source. Because the test woofer is a true monopole, it may be placed inside the vehicle door and used as a band limited radiating source to measure how lossy the interior trim is in the vehicle.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A monopole low frequency test woofer, comprising:

a rigid mounting plate having an acoustical opening;

a monopole driver having a high mass cone and low resonance in free air, said driver being mounted on said mounting plate with a basket of said driver fitting about said acoustical opening;

a rear tub attached to said mounting plate forming an enclosure housing said monopole driver so that sound radiates from said enclosure only through said acoustical opening, a top portion of a rear panel of said rear tub being offset inward toward said mounting plate to have lesser depth than a bottom portion of said rear tub to thereby form a slot;

an electrical connector on said tub for connecting said monopole driver to an external circuit, said electrical connector being positioned in said slot flush with said bottom portion of said rear panel; and an inductor connected in series with said monopole driver, said inductor contouring frequency response of said monopole driver to match frequency response of a vehicle dipole speaker over a frequency range of interest.

2. A test woofer, as set forth in claim 1, wherein the frequency range of interest is from about 40 Hz to about 200 Hz.

3. A method for determining loss in baffling due to speaker environment in a vehicle being non-ideal, comprising the steps of:

mounting a monopole driver having a basket, a high mass cone and low resonance in free air on a mounting plate, said mounting plate having an acoustical opening, said basket of said driver fitting about said acoustical opening;

sealing a tub to said mounting plate enclosing said driver so that sound radiates from said enclosure only through said acoustical opening;

attaching an electrical connector on said tub for connecting said monopole driver to an external circuit;

measuring output of said test woofer in the vehicle; and comparing said test woofer output with output of an optimized vehicle dipole speaker and determining frequency response difference which is the loss in baffling due to speaker environment in the vehicle.

* * * * *